US009555308B2

(12) United States Patent
Nassanian et al.

(10) Patent No.: US 9,555,308 B2
(45) Date of Patent: Jan. 31, 2017

(54) BAG WITH MULTIPLE STORAGE COMPARTMENTS

(71) Applicant: Nike, Inc., Beaverton, OR (US)

(72) Inventors: Hrag Nassanian, Portland, OR (US); David Sagan, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 24 days.

(21) Appl. No.: 14/462,238

(22) Filed: Aug. 18, 2014

(65) Prior Publication Data

US 2016/0045808 A1 Feb. 18, 2016

(51) Int. Cl.

| | |
|---|---|
| ***A63B 71/00*** | (2006.01) |
| ***A45C 3/12*** | (2006.01) |
| ***A45C 3/00*** | (2006.01) |
| ***A45C 13/02*** | (2006.01) |
| ***A45F 3/04*** | (2006.01) |

(52) U.S. Cl.

CPC ..... *A63B 71/0036* (2013.01); *A45C 3/00* (2013.01); *A45C 3/12* (2013.01); *A45C 13/02* (2013.01); *A45F 3/04* (2013.01); *A45C 2003/007* (2013.01)

(58) Field of Classification Search

CPC ..... A63B 71/0036; A45C 3/00; A45C 3/12; A45C 2003/007; A45C 13/02; A45C 7/0077; A45C 7/0086; A45C 13/001; A45C 2013/306; A45C 2003/002; A45F 3/04

USPC ..... 206/315.1, 315.9, 351.91, 278; 190/107; 224/653

See application file for complete search history.

(56) References Cited

U.S. PATENT DOCUMENTS

| | | | | |
|---|---|---|---|---|
| 2,254,578 | A * | 9/1941 | O'Brien | A45C 7/0077 190/107 |
| 5,250,000 | A * | 10/1993 | Boutin | A63F 3/0023 206/315.1 |
| 6,193,034 | B1 * | 2/2001 | Fournier | A45C 7/0095 190/107 |
| 6,286,674 | B1 | 9/2001 | Richard et al. | |
| 7,597,209 | B2 * | 10/2009 | Rothschild | A45C 7/0036 220/23.87 |
| 9,119,448 | B1 * | 9/2015 | Hirshberg | A45C 7/0077 |
| 2002/0144916 | A1 * | 10/2002 | Cheng | A63B 71/0045 206/315.1 |
| 2003/0042160 | A1 * | 3/2003 | Godshaw | A45C 7/0095 206/349 |

(Continued)

FOREIGN PATENT DOCUMENTS

| | | |
|---|---|---|
| WO | 9906304 A1 | 2/1999 |
| WO | 2009004602 A2 | 1/2009 |

OTHER PUBLICATIONS

International Search Report and Written Opinion Dated Feb. 16, 2016 for PCT Patent Application No. PCT/US2015/045484, 17 Pages.

*Primary Examiner* — Chun Cheung

(74) *Attorney, Agent, or Firm* — Shook, Hardy & Bacon L.L.P.

(57) ABSTRACT

A bag includes a main storage compartment and a plurality of accessory storage compartments. The accessory storage compartments are generally separated from the storage space of the main storage compartment and might be used to stow various items, such as athletic balls, shoes, towels, uniforms, sports drinks, sports supplements, and the like. One type of accessory storage compartment includes a ball-bag stowage compartment for storing a ball bag. Another type of accessory storage compartment includes a shoe-stowage compartment.

18 Claims, 9 Drawing Sheets

(56) References Cited

U.S. PATENT DOCUMENTS

| | | | | |
|---|---|---|---|---|
| 2004/0195286 | A1* | 10/2004 | Greenhalgh | A45C 7/0063<br>224/581 |
| 2006/0207900 | A1* | 9/2006 | Lytle | A45C 7/0086<br>206/315.9 |
| 2008/0011567 | A1* | 1/2008 | Hammond | A45C 7/009<br>190/108 |
| 2012/0067682 | A1 | 3/2012 | Liao | |
| 2014/0058737 | A1 | 2/2014 | Ishikawa et al. | |

* cited by examiner

BAG WITH MULTIPLE STORAGE COMPARTMENTS

CROSS-REFERENCE TO RELATED APPLICATIONS

None.

TECHNICAL FIELD

This application is related to a bag that includes a main storage compartment and one or more other storage compartments that are usable to store various items, such as athletic balls, shoes, clothing, towels, drink bottles, and the like.

BRIEF SUMMARY

In brief, and at a high level, this disclosure describes, among other things, a bag that includes main storage compartment, a ball-bag stowage compartment, a shoe-stowage compartment, or a combination thereof.

Another aspect of the present invention includes a bag with a main compartment having at least a base wall, a first side wall, and a second side wall and divided into at least a first storage area and a second storage area. Among other elements, a ball bag might be affixed to the base wall, the first side wall, the second side wall, or a combination thereof, and is stowable in the second storage area. In addition, the bag includes a first shoe storage area and a second shoe storage area positioned external to the main compartment.

An additional aspect of the present invention includes a bag having a base panel, a first side wall, a second side wall, and an end wall, which releasably attaches to the first side wall and the second side wall. In addition, the base panel, the first side wall, the second side wall, and the end wall at least partially enclose a storage compartment. The bag might also include a dividing wall positioned in the storage compartment, wherein a bag storage portion is defined between the dividing wall and the end wall. A ball bag might be affixed to the first side wall, the second side wall, the end wall, or a combination thereof.

A further aspect of the present invention includes bag with a storage compartment defined by a base wall, a first side wall, and a second side wall. The base wall generally opposes a storage-compartment opening, which provides access to the storage compartment. In addition, the first side wall includes a first lower portion coupled to the base wall and a first upper portion, and the second side wall includes a second lower portion coupled to the base wall and a second upper portion. In one aspect, the first upper portion and the second upper portion include a first releasable fastener and second releasable fastener, respectively, that releasably connect to one another to selectively close and open the storage-compartment opening. The bag also includes a first shoe stowage compartment comprising a first security flap that is coupled to a first outside surface of the first side wall. The first security flap includes a first top portion oriented toward the first upper portion and a first bottom portion oriented toward the first lower portion, and at least part of the first top portion is fixedly secured to the first outside surface. In addition, the first security flap at least partially encloses a first stowage space between an inside surface of the first security flap and the first outside surface of the first side wall, the first stowage space gradually increasing in volume as the first stowage space extends away from the first top portion and toward the second bottom portion. The bag further includes a second shoe stowage compartment, which is similar to the first shoe stowage compartment.

Aspects of the invention are defined by the claims below, not this summary. This summary merely provides a high-level overview of various aspects of the invention and introduces a selection of concepts that are further described below in the detailed-description section. This summary is not intended to identify key or essential features of the claimed subject matter, nor is it intended to be used as an aid in isolation to determine the scope of the claimed subject matter.

BRIEF DESCRIPTION OF THE DRAWINGS

The present invention is described in detail herein with reference to the attached drawings, which are incorporated herein by reference, wherein.

DETAILED DESCRIPTION

The subject matter of aspects of the present invention is described with specificity herein to meet statutory requirements. But the description itself is not intended to necessarily limit the scope of claims. Rather, the claimed subject matter might be embodied carried out in other ways to include different elements or combinations of elements similar to the ones described in this document, in conjunction with other present or future technologies.

Aspects hereof provide a bag that includes a main storage compartment and a plurality of accessory storage compartments. The main storage compartment generally includes a storage space that is larger than the accessory storage compartments and that might include one or more additional storage pockets accessible from inside the storage space or outside the storage space. The accessory storage compartments are generally separated from the storage space of the main storage compartment and might be used to stow various items, such as athletic balls, shoes, towels, uniforms, sports drinks, sports supplements, and the like. The terms "storage" and "stowage" might be used interchangeably in this description, as well as the terms "storage area," "compartment," and "storage space."

In a further aspect the bag is wearable. For instance, the bag might include one or more straps that can be worn on one or both shoulders. In one aspect, the bag is designed such that when items are stored in the bag and the bag is worn, the stored items are retained towards an upper portion of the bag, as opposed to be allowed to sink towards a bottom of the bag.

Figure 1:
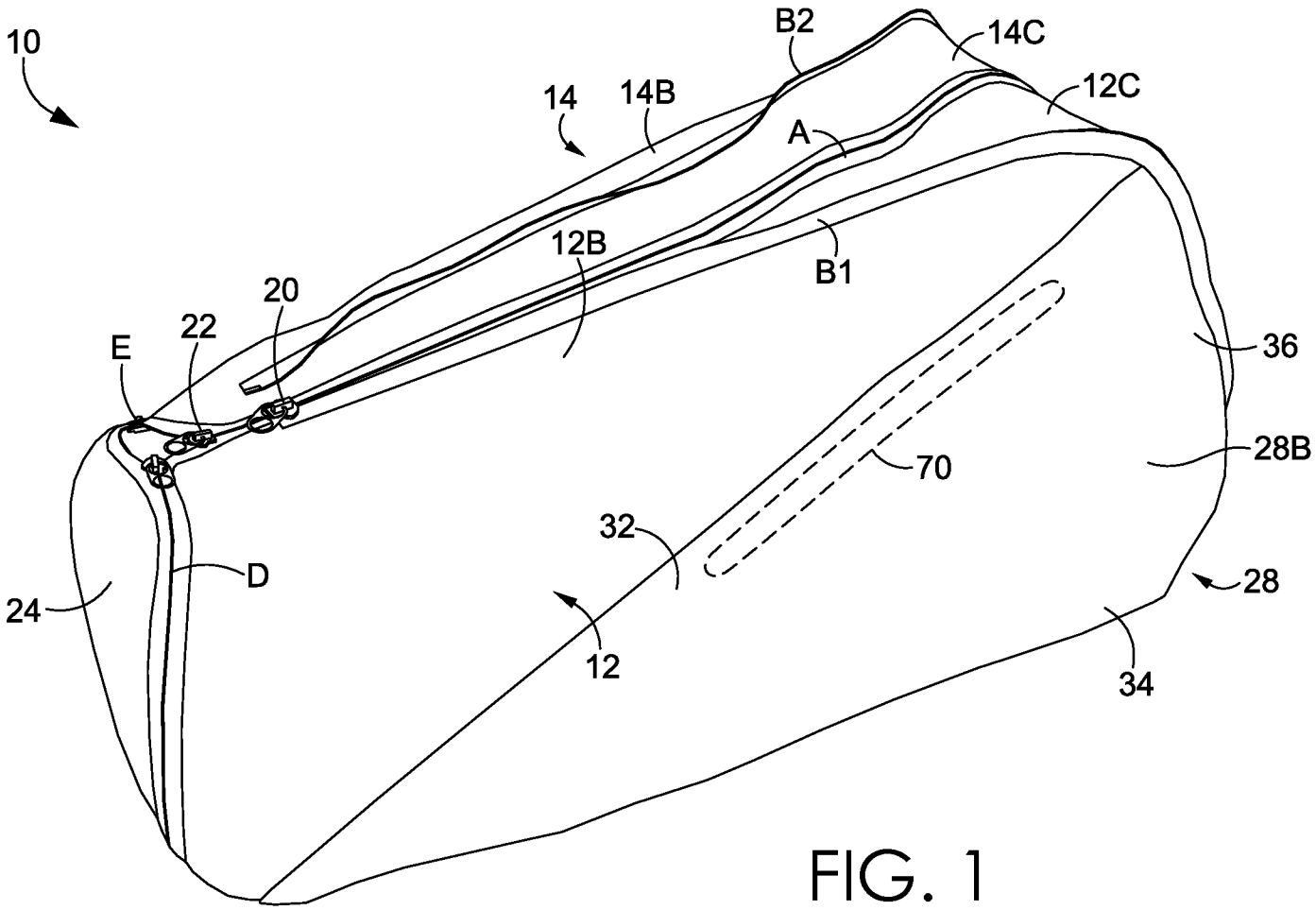
FIG. 1 depicts a bag in accordance with an aspect hereof.

Referring now primarily to FIG. 1, some features of a bag 10 will be generally described. FIG. 1 depicts a non-worn state of the bag 10, such as when the bag might be set on a ground surface. Generally the bag 10 includes one or more side walls 12 and 14 coupled to a base wall (hidden from view in FIG. 1, but shown as item 16 in FIG. 3), which at least partially enclose a storage space (item 18 in FIG. 4). In addition, the bag 10 includes one or more zipper attachments 20 and 22 that provide access to the storage space. For exemplary purposes, zipper attachments are described herein and are depicted in the figures; however, any suitable releasable fastener might also be used to releasably connect portions of the bag, such as snaps, hook-and-loop fastening strips, clips, and the like.

Figure 2:
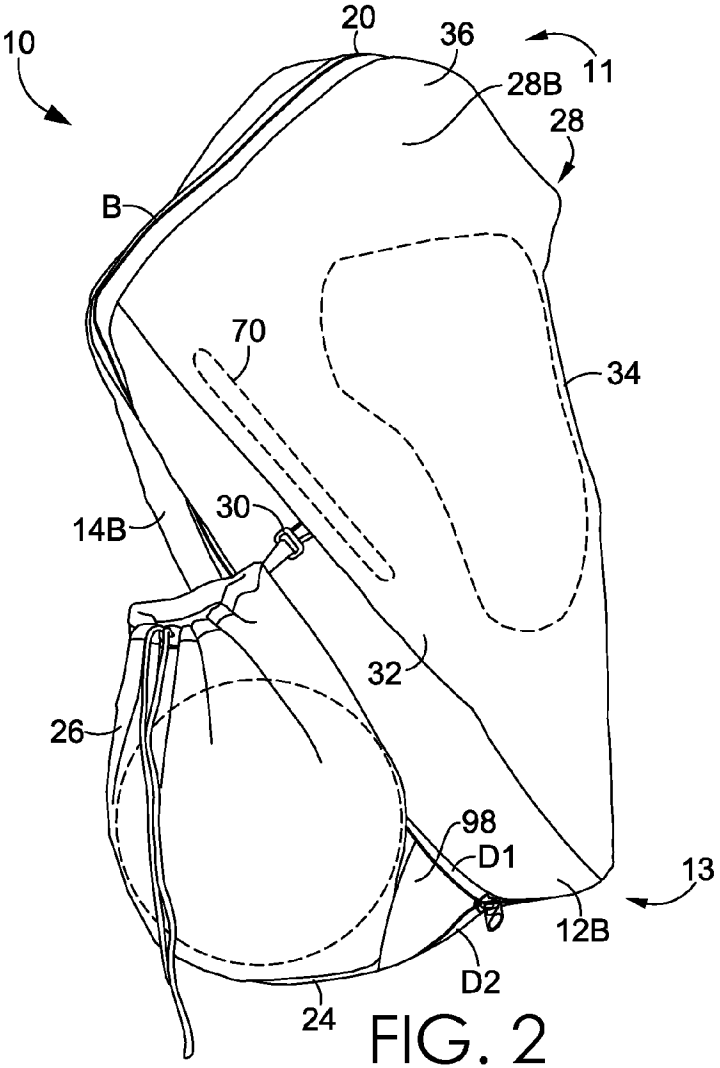
FIG. 2 depicts the bag of FIG. 1 with a ball bag in accordance with an aspect hereof.
Figure 4:
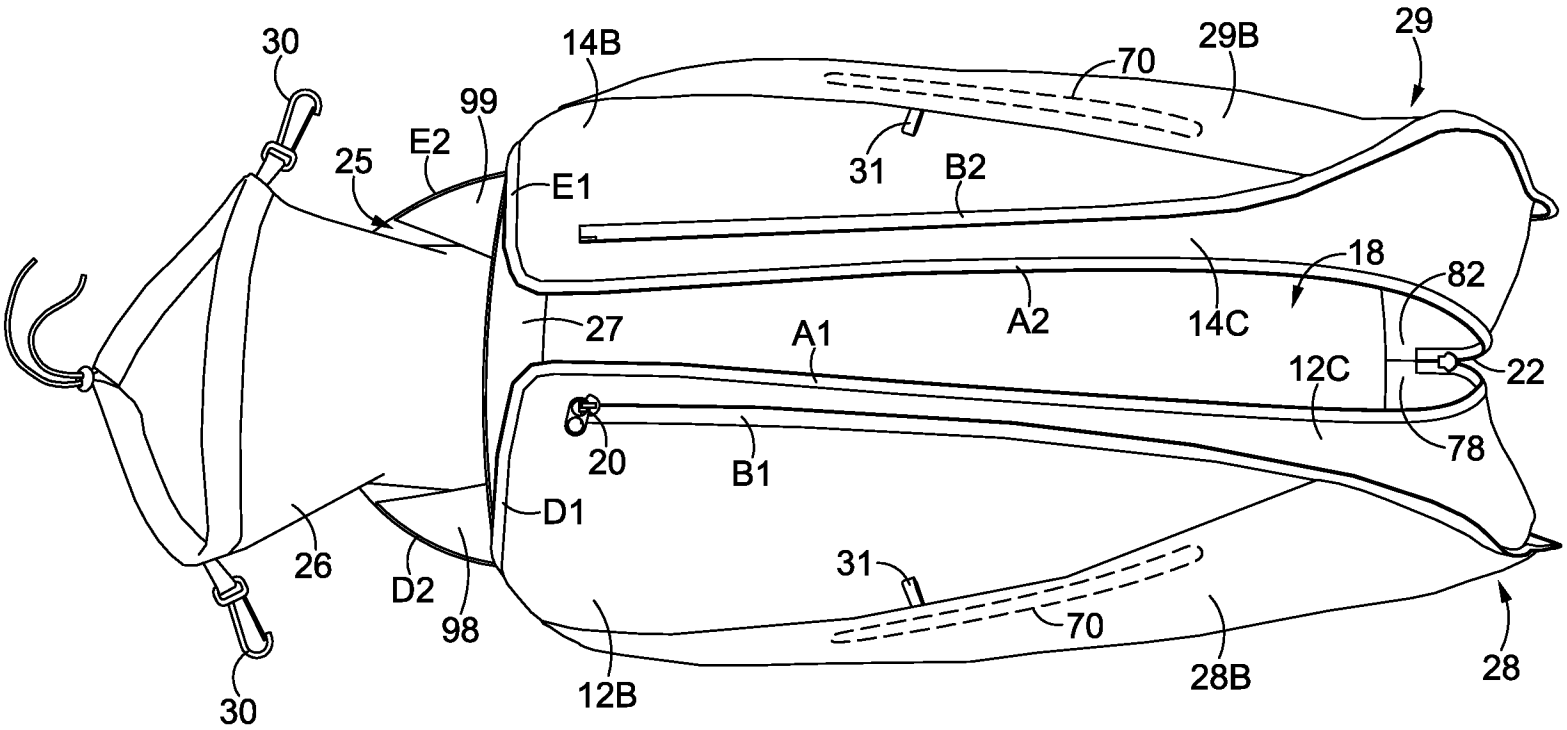
FIG. 4 depicts a top elevated view of the bag of FIG. 1 with a main compartment in an open arrangement and a ball bag in accordance with an aspect hereof.

FIG. 1 also depicts an end wall 24 that releasably attaches to the side walls 12 and 14. In one aspect, the end wall 24 is detachable from the side walls 12 and 14 to open a ball-bag-stowage compartment 25. For example, FIGS. 2 and 4 depict a ball bag 26 that is coupled at one end to the bag (e.g., to the end wall 24 and/or the side walls 12 and 14) and that is dispensed or pulled from the ball-bag-stowage compartment 25. In one aspect, the bag 10 includes a dividing wall 27, which at least partially separates the storage space 18 from the ball-bag-stowage compartment 25. In a further aspect, the ball bag 26 includes releasable fasteners 30 that are attachable to a portion (e.g., loops 31 on the outside surface of the side wall) of the bag 10 when a ball is stored in the ball bag 26. Although item 26 is referred to as a "ball bag" and a ball is depicted stored in the ball bag 26 in one or more figures, it is understood that various other types of items might be stored in the bag 26, such as soiled uniforms, towels, etc.

Figure 3:
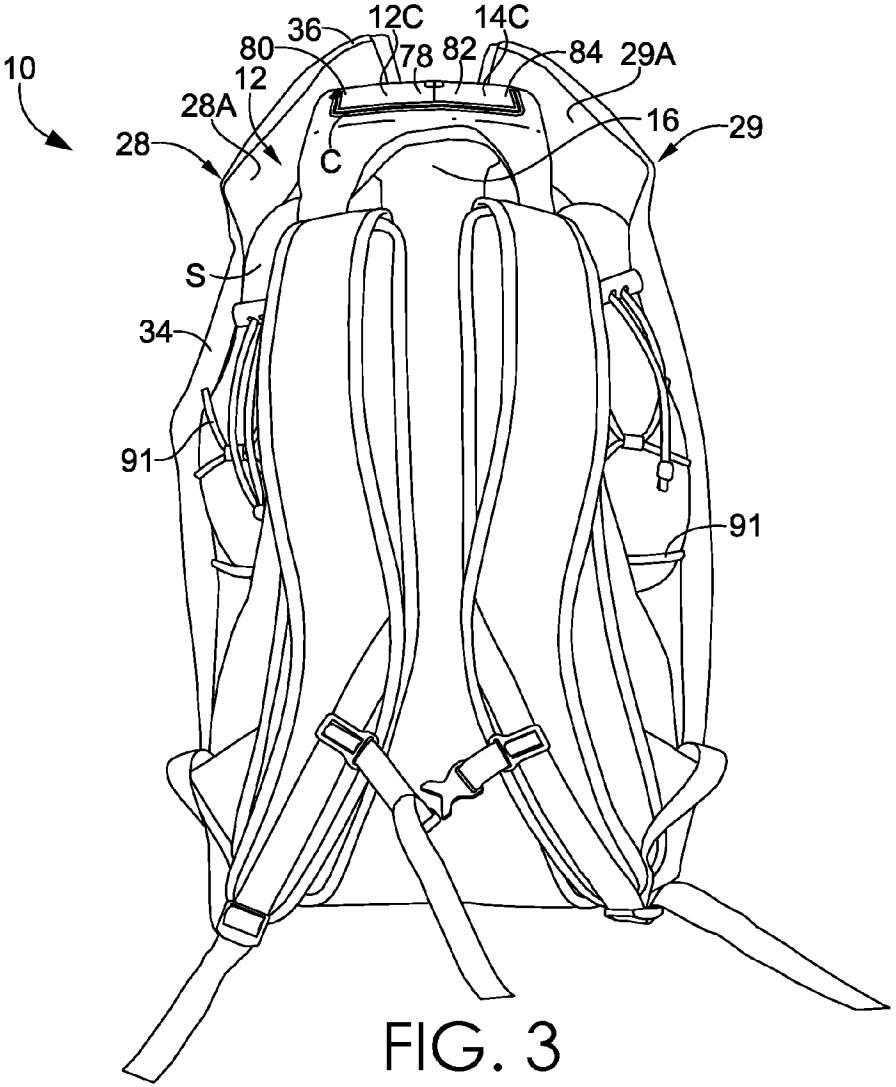
FIG. 3 depicts the bag of FIGS. 1 and 2 with a shoe-stowage area and straps in accordance with an aspect hereof.

In addition, FIG. 1 depicts a security flap 28 that is coupled to the side wall 12. In one aspect, the security flap 28 partially encloses a shoe-stowage area, which is positioned between the security flap 28 and the side wall 12. For exemplary purposes, a shoe is depicted in a ghost view in FIG. 2, and FIG. 3 depicts a shoe "S" positioned between the security flap 28 and the side wall 12. In one aspect, a top portion 32 of the security flap 28 is fixedly secured to the side wall 12, such that the shoe-stowage area is not accessible at the top portion 32. For example, the top portion 32 might be stitched, adhered, sonic welded, or integrally woven with the side wall 12. In a further aspect, the security flap 28 is spaced apart from the side wall 12 near the bottom portion 34, such that the shoe-stowage area is accessible near the bottom portion 34 and or the end portion 36.

In one aspect, the construction of the security flap 28 and the bag 10 create the shoe-stowage area that is shaped to correspond with a shoe, such as a basketball shoe. For instance, a volume of the shoe-stowage space is larger near the upper portion 11 (FIG. 2) of the bag 10 as compared with the lower portion 13, and the larger volume might correspond with a back or heel portion of a shoe, which includes ankle support structures. In addition, the shoe-stowage space expands towards the bottom portion 34 to accommodate a sole portion of a shoe, which is sometimes wider and more rigid than a shoe upper, and the shoe upper can be positioned in the shoe-stowage area near the top portion 32. Although aspects of this description refer to a "shoe-stowage area" and a shoe is depicted in some of the figures, it is understood that various other types of items might be stored in the shoe-storage area, and the claimed subject matter is not to be unduly limited to storing shoes in the shoe-stowage area.

The ball-bag stowage area, the shoe-stowage area, the construction of the bag 10, and other features of the bag 10 are now described in more detail. When referring to FIGS. 5A-5F, a general order is described for exemplary purposes of how the bag 10 might be assembled. However, the express order described is not necessarily indicative of a prescribed order of steps or a required order of steps. Rather, the bag 10 might be assembled by following similar steps in a different order.

Figure 5A:
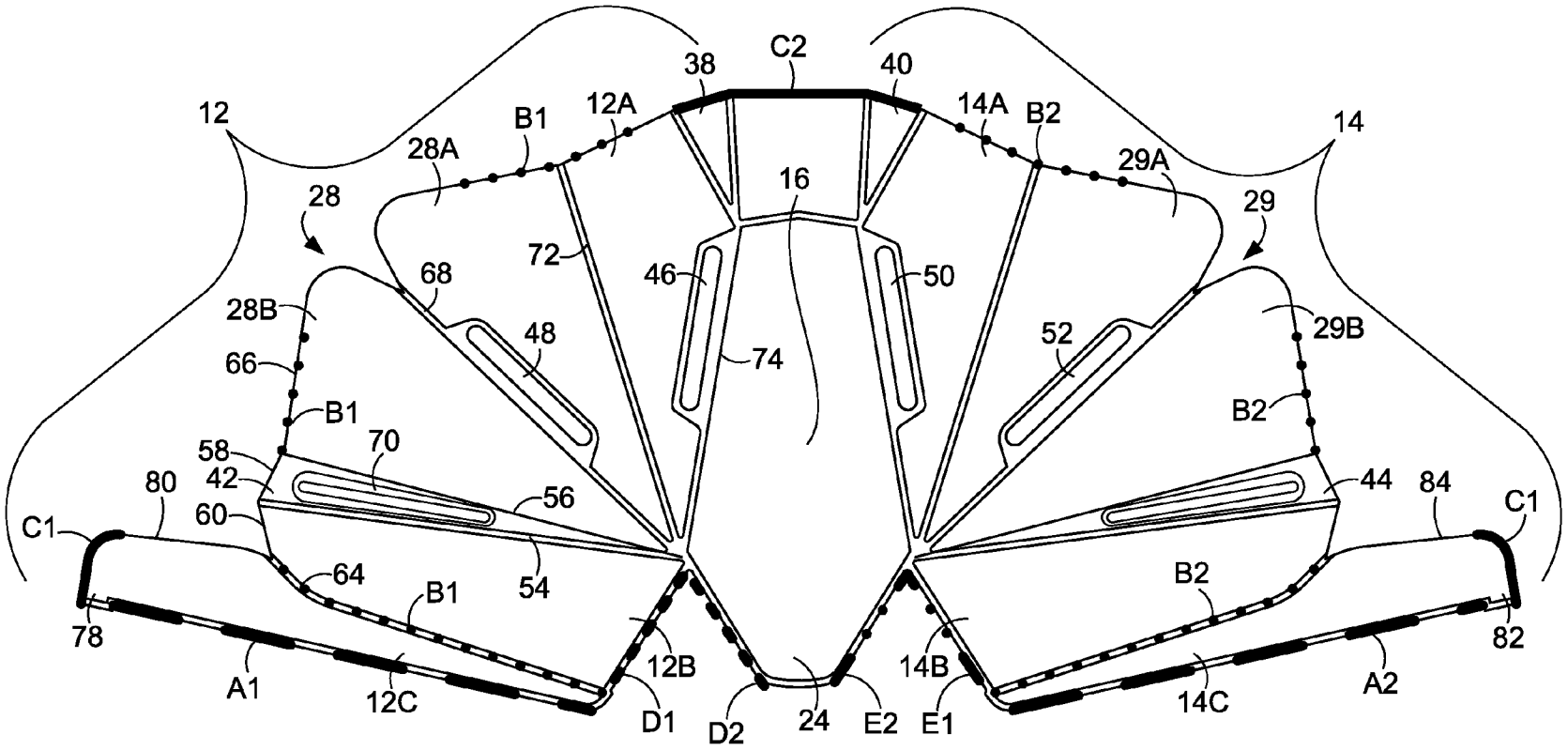
FIGS. 5A-5F depict panels of a bag in respective configurations in accordance with an aspect hereof.

Referring now to FIG. 5A various panels and walls of the bag are illustrated in an unattached, flat arraignment. That is the panels are shown as they might appear prior to being affixed to one another to construct the bag 10. The textile of the bag might include various types of fabric or materials, and in one aspect, the bag constructed of a multi-layer woven fabric created using dual-loom technology (e.g., Jacquard weave). In a further aspect, the panel configuration depicted in FIG. 5A is woven as a single-piece construction having the pattern depicted. That is, the panels and walls are integrally woven together as a single unit, using a single set of continuous filaments. Although woven as a single-piece construction, the panels might also include additional material (e.g., yarn, reinforced layers, etc.) included in the single-piece construction. The panels might be folded and affixed to one another using various attachment techniques such as sewing, stitching, adhering, sonic welding and the like, in order to construct the bag 10.

In FIG. 5A the pattern of the bag includes a left side and a right side which are essentially mirror images of one another. For explanatory purposes, a description of one side of the pattern also applies respectively to the other side of the pattern, unless otherwise indicated. In addition, some panels might be described in relative terms (e.g., left, right, upper, lower, bottom, top, floor, ceiling, etc.) for explanatory purposes, but this relative terminology is not intended to unduly limit the claimed subject matter. For example, a panel might be labeled as "top" or "upper" if the panel is higher than other panels when the bag is worn as a backpack. But panels might also be labeled as a floor, ceiling, or bottom based on a position of the panels when the bag is not worn. As such, these relative terms are merely provided for explanatory and illustrative purposes based on a context (e.g., worn or unworn).

FIG. 5A depicts the base wall 16 connected to side walls 12 and 14, and the base wall 16 is integrally formed with the end wall 24. In FIG. 5A, the side walls (e.g., side walls 12 and 14 depicted in FIG. 1) include multiple panels. For example, the side wall 12 (FIG. 1) includes side-wall lower panel 12A, side-wall upper panel 12B, and side-wall extension panel 12C. In addition, the side wall 14 includes side-wall lower panel 14A, side-wall upper panel 14B, and side-wall extension panel 14C.

In a further aspect, the security flap 28 is integrally woven as part of the side wall 12 and continuously formed with other panels of the side wall 12. For example, FIG. 5A depicts the security flap 28 having multiple panels, including an inside panel 28A and an outside panel 28B. FIG. 5A also depicts a first pleat panel 38 and a second pleat panel 42, which are also part of the side panel 12. As previously indicated, the side panel 14 is essentially a mirror image of the side panel 12. As such, FIG. 5A depicts another security flap 29, having an inside panel 29A and an outside panel 29B, as well as a third pleat panel 40 and a fourth pleat panel 44. In one aspect, the pattern is supplemented with reinforcement areas 46, 48, 50, and 52, which provide an attachment point for shoe-stowage retention mechanisms (e.g., elastic textile, cord, or netting).

FIG. 5A depicts a plurality of edges that include a zipper attachment mechanism (e.g., zipper teeth) when the panels are folded into a bag configuration. These edges are depicted in 5A by a particular line type (e.g., thick line, dashed line, dash-and-bullet line, and the like), and edges that are connectable by a zipper slider when in the bag configuration are depicted by a same line type. For illustrative purposes, zipper-teeth strips that mate are designated by a same letter (e.g., A1 mates with A2, B1 mates with B2, C1 mates with C2, D1 mates with D1, and E1 mates with E2). In addition, some of the edges that are eventually combined into a continuous zipper-teeth strip are depicted in FIG. 5A as disconnected. These edges are eventually abutted substantially end-to-end when the panels are folded and attached. For example, a set of disconnected edges are identified by "B1" but these edges are eventually arranged in a continuous, end-to-end configuration, which allows a continuous zipper-teeth strip to be attached. The same applies to B2 and C1.

The bag 10 might be constructed from the panels of FIG. 5A by applying various techniques and steps. For example, a panel junction 54 (between the pleat panel 42 and the side-wall upper panel 12B) and another panel junction 56 (between the pleat panel 42 and the outside panel 28B) might be folded, such that a pleat-panel edge 58 of the pleat panel 42 is aligned with a top edge 60 of the side-wall upper panel 12B and with at least part of an edge 66 of the outside panel 28B.

Figure 5B:
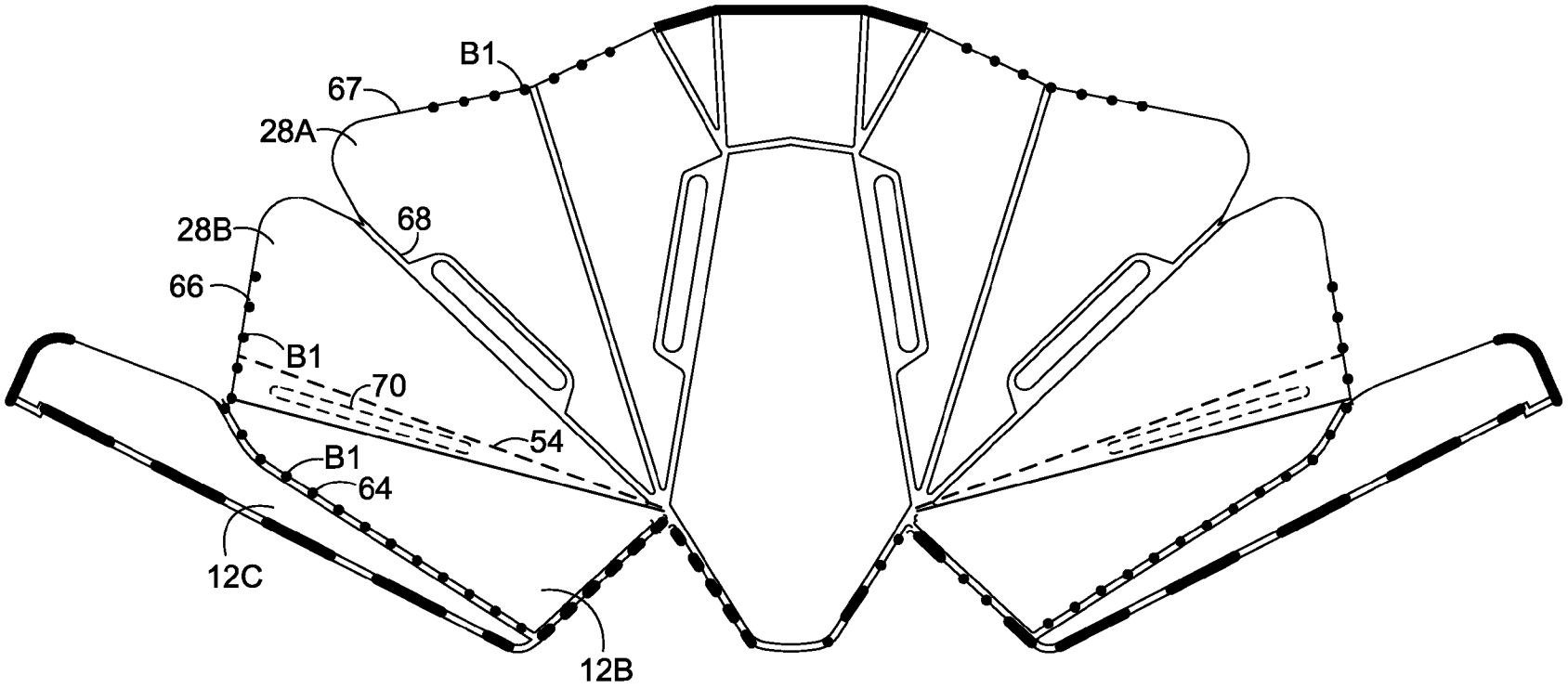

FIG. 5B depicts the arrangement of panels after the pleat-panel edge 58 is aligned with the top edge 60, and the pleat panel 42 is hidden from view by the outer panel 28B. Although the pleat panel 42 is folded between the outer panel 28B and the side-wall upper panel 12B and is hidden from view, a dashed line is provided for illustrative purposes to depict an approximate location of the pleat panel 42 behind the outer panel 28B. In one aspect, the pleat panel 42 is constructed to include an opening 70, which provides access to a pocket created between the panels 28A and 28B.

As illustrated by FIG. 5B, a panel junction 64 between the side-wall upper panel 12B and side-wall expansion panel 12C substantially aligns with an outer edge 66 of the security-flap outer panel 28B when the pleat panel 42 is folded in the manner described. In an aspect of the invention, these aligned edges, which are also depicted by a "B1" having a common line type, are included in a same contiguous zipper-teeth strip when the bag 10 is constructed.

In a further aspect, a panel junction 68 between the security-flap outer panel 28B and the security-panel inner panel 28A is folded, such that the security-flap outer panel 28B and the security-panel inner panel 28A are in a stacked arrangement, one on top of the other. The outer panel 28B and inner panel 28A are affixed to one another (as will be described in other portions of this description) to form the security flap 28. For instance, at least part of edges 66 and 67 might be fixedly attached two one another, such as by sewing, adhering, and the like. As such, a pocket is formed between the outer panel 28B and inner panel 28A and is accessible through the opening 70, which is selectively closable using a releasable fastener (e.g., zipper attachment) and is depicted in the pleat panel 42. Although the pocket-access opening 70 is depicted in the pleat panel 42, the opening 70 could also be constructed into other portions of the bag, such as near a lower portion 34 of the flap 28. The stacked arrangement of the outer panel 28B and inner panel 28A is depicted in FIG. 5C, in which the outer panel 28B, which was viewable in FIG. 5B, is now hidden from view behind the inner panel 28A.

Figure 5C:
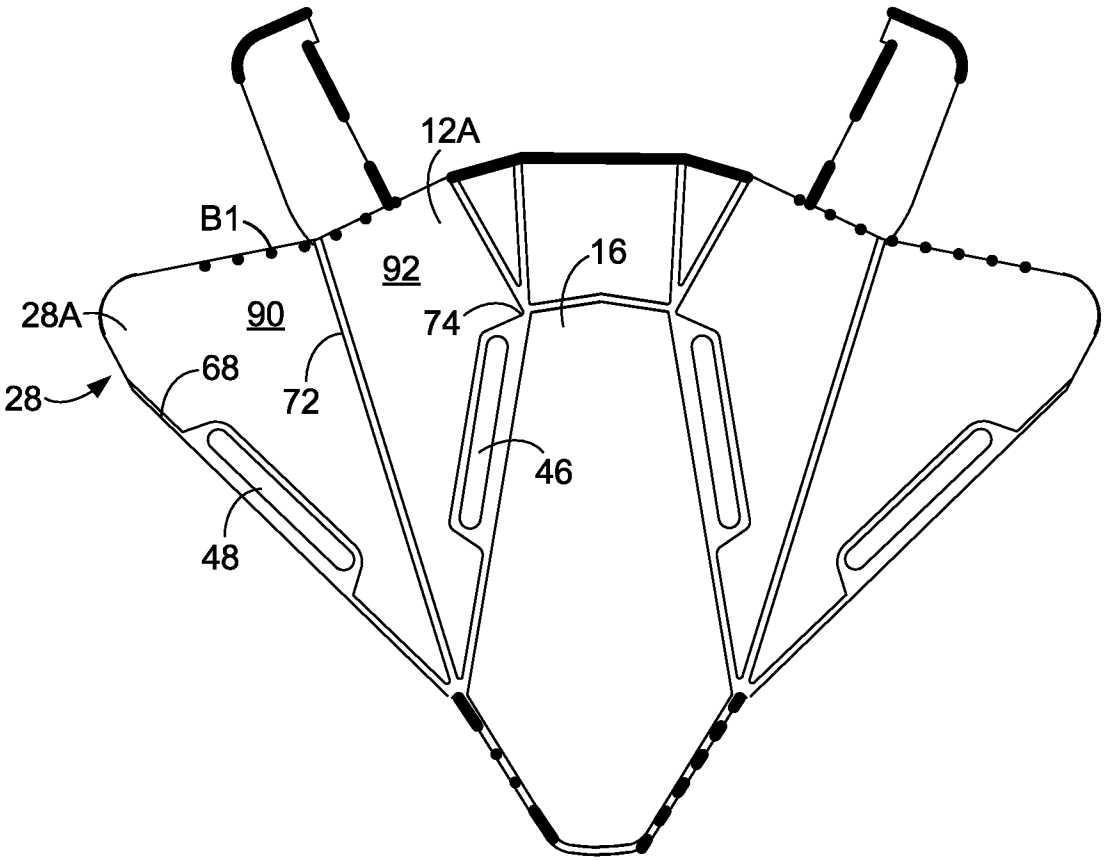
Figure 5D:
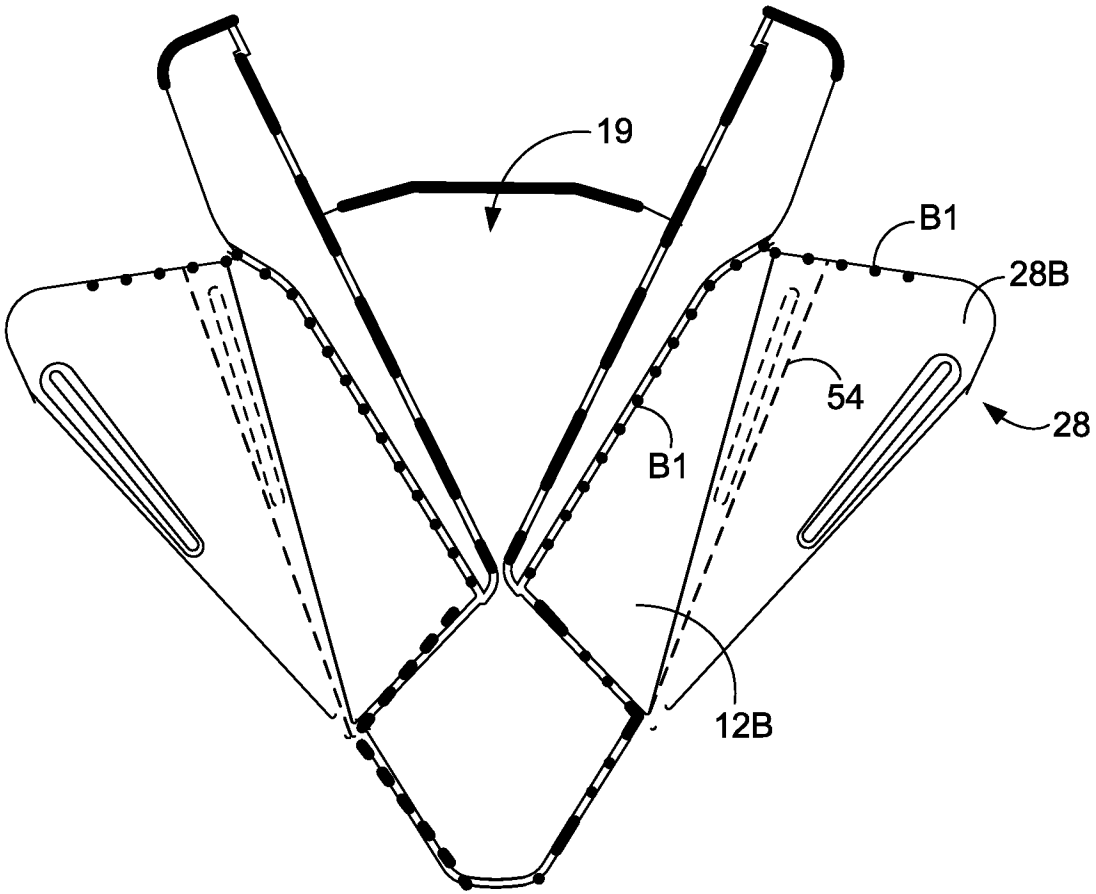

Referring to FIG. 5D, an opposing-side view (as compared to FIG. 5C) is depicted in which the outer panel 28B is illustrated on top of the inner panel 28*a*, which is hidden from view. In addition, FIG. 5D includes a broken line 54 to indicate a position of the pleat panel 42 between the outer panel 28B and the side-wall upper panel 12B. In FIG. 5D, the pocket opening 70 is depicted in a broken line to show a general position of the opening 70 and to illustrate how the opening is at least partially concealed between the panels 28B and 12B. Thus, when the bag 10 is fully constructed, the at least partially concealed position of the pocket opening 70 can provide some additional security, and this aspect is illustrated by the broken-line depiction of the pocket opening 70 in FIGS. 1, 2, 4, and 5F. FIG. 5D further illustrates a general alignment of the "B1" edges. In addition, the depicted panels in FIG. 5D at least partially enclose a space 19, which roughly corresponds with the storage space 18 depicted in FIG. 4.

Referring back to FIG. 5C, in another aspect, a panel junction 72 between the security-flap inner panel 28A and the side-wall lower panel 12A is folded, such that the panel junction 68 is generally aligned with another panel junction 74, which joins the base wall 16 and the side-wall lower panel 12A. When the panel junction 72 is folded, the entire security flap 28 is positioned against the lower panel 12A, such that a surface 90 of inner panel 28A generally faces a surface 92 of the lower panel 12A. As such, the inner panel 28A and the lower panel 12A at least partially enclose a space between the surfaces 90 and 92 that at least partially defines the shoe-stowage area. In addition, the reinforced area 48 (on the inner panel 28A) is generally aligned with the other reinforced area 46 (on the lower panel 12A) when the panel junction 72 is folded. As such, an adjustable-length shoe-retention mechanism can be attached to the reinforced areas, such as a cord with barrel lock, netting, or elastic textile.

Figure 5E:
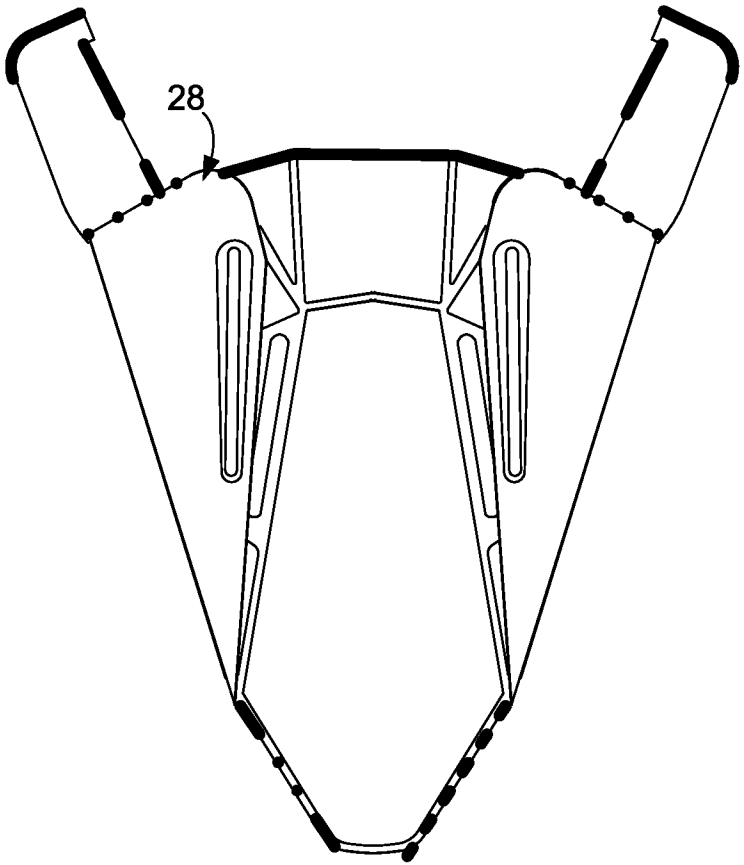

In FIG. 5E the depicted view illustrates a possible transition from FIG. 5C when the security flap 28 is folded over and on top of the lower panel 12A, which is mostly hidden from view.

Figure 5F:
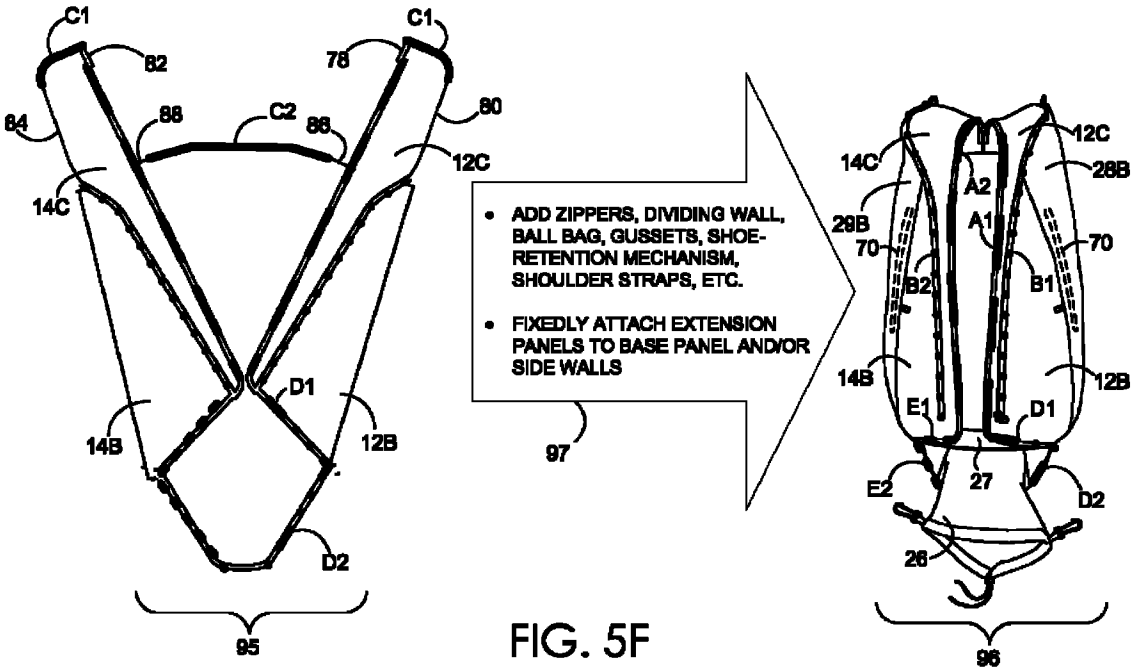

Referring now to FIG. 5F, a first configuration 95 and a second configuration 96 are illustrated, and an arrow 97 illustratively depicts that, in one aspect, the first configuration 95 is constructed into the second configuration 96. The first configuration 95 shows an exemplary depiction of the opposing side of the view provided by FIG. 5E. The second configuration 96 is similar to the bag depicted in FIG. 4, but line types are added to the second configuration 96 to be consistent with the first configuration 95 and to illustratively track a step-by-step alignment of the line types.

The first configuration 95 depicts the other side of the panels that are hidden from view in FIG. 5E, including the upper panels 12B and 14B and expansion panels 12C and 14C. The expansion panel 12C includes an inner edge 78 and an outer edge 80, and the expansion panel 14C also includes an inner edge 82 and an outer edge 84. In the first configuration 95, FIG. 5F further depicts a lower-panel edge 86 of lower panel 12A and a lower-panel edge 88 of lower panel 14A. In one aspect, when transition to the second configuration 96, the inner edges 78 and 82 are affixed to one another, and the "C1" edges are aligned (e.g., end to end). In addition, the outer edge 80 of expansion panel 12C is affixed to the lower-panel edge 86 of lower panel 12A, and the outer edge 84 of expansion panel 14C is affixed to the lower-panel edge 88 of lower panel 14A. In turn, the C1 zipper teeth are aligned with the C2 zipper teeth to be selectively coupled by a zipper slide. The combination of the C1 and C2 are referred to herein as the "C" zipper (depicted in FIG. 3). FIG. 4 labels some of the features of the bag in greater detail to illustratively depict the edges 82 and 78.

Additional processing steps might be executed to transform the first configuration 95 into the second configuration 96, and reference might be made to any of the figures when describing the transition to the second configuration. For example, additional pockets might be sewn into the interior of the storage space 18, which are accessible via zipper "C"

(FIG. 3). In one aspect, the zipper "C" provides access to an insulated compartment. In addition, zipper strips (e.g., zipper teeth) might be added to A1, A2, B1, B2, C1, C2, D1, D2, E1, and E2. In another aspect, the dividing wall 27 is affixed to the base 16 and/or the side walls, and the ball bag 26 is fixedly attached to the base, end wall, and/or side walls. In a further aspect, loops (or other attachment or anchor points) 31 are sewn into the outside surface of the wall, such as between the pleat panel 42 and the upper panel 12B, and provide a structure to which the ball-bag releasable fasteners 30 can attach. In addition, gussets 98 and 99 (e.g., FIG. 4) might be affixed to connect the end wall 24 to the side walls 12 and 14.

Referring to FIG. 4, an aspect of the invention includes an outer zipper (B1 selectively connectable to B2 by slide 20) and inner zipper (A1 selectively connectable to A2 by slide 22). Among other things the inner zipper (A1 and A2) opens and closes to control access to the main storage compartment 18. As depicted in FIG. 1, the inner zipper (with slide 22), intersects with the other zippers "E" and "D" that connect the end wall 24 to the side walls 12 and 14. The outer zipper can be zipped (using slide 20) to collapse the expansion panels 12C and 14C and make the overall size of the bag more compact. Unzipping the outer zipper expands the storage capacity of the bag 10 and provides access to the inner zipper. When the outer zipper is zipped it provides an added layer of security to control access to the inner zipper and to the main storage compartment.

Referring back to FIG. 2, the bag 10 is depicted in an as-worn orientation. In FIG. 2, the bag includes a top end 11 and a bottom end 13. In one aspect, a main storage compartment (e.g., 18) is positioned proximate to the top end 11, and a second storage area (e.g., ball-bag stowage area 25 in FIG. 4) is positioned proximate to the second end 13. In a further aspect, a volume of the main compartment gradually decreases from the first end to the second end. The gradually decreasing volume might bias items stored in the bag away from the bottom end 13 and raise the overall load of the bag 10 to improve carryability by distributing the weight higher on the person. In addition, the ball bag 26 includes one or more releasable fastening mechanisms 30 that releasable attach to the first side wall, to the second side wall, or to both the first side wall and the second side wall. In one aspect, the ball bag impedes expansion of the volume when the one or more releasable fastening mechanisms are releasably attached. As such, the items in the ball bag 26 (e.g., a ball) function similar to a shelf (or air bladder), which biases items stored in the main compartment upward and raises the load.

With continued reference to FIGS. 2 and 3, the bag 10 provides a shoe-stowage area that is separate from the main storage compartment. The shoe-stowage area can be relatively easy to access by adjusting the shoe-retention mechanism 91 (e.g., cord with barrel lock, elastic netting or mesh, etc.) to either stow or remove a shoe. In a further aspect, when the bag 10 is worn, the opening to the shoe-stowage area generally faces toward the person wearing the bag, which provides some additional security against theft, falling out, and the like.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

As used herein and in connection with the claims listed hereinafter, the terminology "any of claims" or similar variations of said terminology is intended to be interpreted such that features of claims may be combined in any combination. For example, an exemplary claim 4 may indicate the method/apparatus of any of claims 1 through 3, which is intended to be interpreted such that features of claim 1 and claim 4 may be combined, elements of claim 2 and claim 4 may be combined, elements of claims 3 and 4 may be combined, elements of claims 1, 2, and 4 may be combined, elements of claims 2, 3, and 4 may be combined, elements of claims 1, 2, 3, and 4 may be combined, and/or other variations. Further, the terminology "any of claims" or similar variations of said terminology is intended to include "any one of claims" or other variations of such terminology, as indicated by some of the examples provided above.

The invention claimed is:

1. A bag comprising:

a main compartment having at least a base wall, a first side wall, and a second side wall and including at least a first storage area and a second storage area, wherein the first side wall includes a first set of one or more panels, and wherein the second side wall includes a second set of one or more panels;

a ball bag affixed to the base wall, the first side wall, the second side wall, or any combination thereof, and positioned in the second storage area;

a first accessory storage area positioned external to the main compartment, the first accessory storage area sharing at least a portion of a panel of the first set of one or more panels, the first accessory storage area including a first security flap that is coupled to the first side wall and that at least partially encloses a first stowage space between an inside surface of the first security flap and an outside surface of the first side wall; and a second accessory storage area positioned external to the main compartment, the second accessory storage area sharing at least a portion of a panel of the second set of one or more panels, the second accessory storage area including a second security flap that is coupled to the second side wall and that at least partially encloses a second stowage space between an inside surface of the second security flap and an outside surface of the second side wall.

2. The bag of claim 1, wherein the first side wall includes a first-side upper panel and a first-side lower panel, which at least partially encloses the first shoe stowage space, and wherein the second side wall includes a second-side upper panel and a second-side lower panel, which at least partially encloses the second shoe stowage space.

3. The bag of claim 2, wherein the first security flap includes a first inside panel coupled to the first-side lower panel and a first outside panel coupled to the first inside panel and to the first-side upper panel; and wherein the second security flap includes a second inside panel coupled to the second-side lower panel and a second outside panel coupled to the second inside panel and to the second-side upper panel.

4. The bag of claim 3 further comprising a first pocket between the first inside panel and the first outside panel and a second pocket between the second inside panel and the second outside panel.

5. The bag of claim 1, wherein the main storage compartment includes a first end and a second end, wherein the first storage area is positioned proximate to the first end and the second storage area is positioned proximate to the second end, and wherein a volume of the main compartment gradually decreases from the first end to the second end.

6. The bag of claim 5, wherein the ball bag includes one or more releasable fastening mechanisms that releasable attach to the first side wall, to the second side wall, or to both the first side wall and the second side wall, and wherein the ball bag impedes expansion of the volume when the one or more releasable fastening mechanisms are releasably attached.

7. The bag of claim 1, wherein the main compartment further comprises a dividing wall that attaches to the first side wall and to the second side wall and that at least partially separates the first storage area from the second storage area.

8. The bag of claim 7, wherein the main compartment further comprises an end wall that is attached to the base and that releasably attaches to the first side, the second side, or a combination thereof, and wherein the second storage area is at least partially defined by the end wall and the dividing wall.

9. The bag of claim 8, wherein the end wall is integrally formed with the base and includes a first zipper mechanism for attachment to the first side wall and a second zipper mechanism for attachment to the second side wall, and wherein the first zipper mechanism and the second zipper mechanism meet at an intersection with a third zipper mechanism, which connects the first side wall to the second side wall.

10. A bag comprising:

a storage compartment defined by a base wall generally opposing a storage-compartment opening, which provides access to the storage compartment, a first side wall including a first lower portion coupled to the base wall and a first upper portion, and a second side wall including a second lower portion coupled to the base wall and a second upper portion, wherein the first upper portion and the second upper portion include a first releasable fastener and second releasable fastener, respectively, that releasably connect to one another to selectively close and open the storage-compartment opening;

a first shoe stowage compartment comprising a first security flap that is coupled to a first outside surface of the first side wall, wherein the first security flap includes a first top portion oriented toward the first upper portion and a first bottom portion oriented toward the first lower portion, wherein at least part of the first top portion is fixedly secured to the first outside surface, and wherein the first security flap at least partially encloses a first stowage space between an inside surface of the first security flap and the first outside surface of the first side wall, the first stowage space gradually increasing in volume as the first stowage space extends away from the first top portion and toward the first bottom portion; and a second shoe stowage compartment comprising a second security flap that is coupled to a second outside surface of the second side wall, wherein the second security flap includes a second top portion oriented toward the second upper portion and a second bottom portion oriented toward the second lower portion, wherein at least part of the second top portion is fixedly secured to the second outside surface, and wherein the second security flap at least partially encloses a second stowage space between an inside surface of the second security flap and the second outside surface of the second side wall, the second stowage space gradually increasing in volume as the second stowage space extends away from the second top portion and towards the second bottom portion.

11. The bag of claim 10 further comprising, a first retention mechanism affixed to the first bottom portion of the first security flap and to the outside surface of the first side wall, the first retention mechanism at least partially enclosing the first stowage space, and a second retention mechanism affixed to the second bottom portion of the second security flap and to the outside surface of the second side wall, the second retention mechanism at least partially enclosing the second stowage space.

12. The bag of claim 11, wherein the first retention mechanism and the second retention mechanism each comprises a respective adjustable-length mechanism, which includes at least a first length and a second length, and wherein the second length reduces a volume of the respective stowage space relative to the first length.

13. The bag of claim 10, wherein the first upper portion includes a first extension panel that includes a terminating edge of the first side wall, the terminating edge comprising the first releasable fastener of the first upper portion that releasably connects to the second releasable fastener of the second upper portion, wherein the first upper portion further comprises a third releasable fastener that is spaced apart from the first releasable fastener and that traverses at least part of the first upper portion and extends along at least part of the first security flap, and wherein the second upper portion further comprises a fourth releasable fastener that is spaced apart from the second releasable fastener and that traverses at least part of the second upper portion and extends along at least part of the second security flap, the third and fourth releasable fasteners mating with one another to reduce a volume of the storage compartment and to releasably connect the first security flap and the second security flap.

14. The bag of claim 10, wherein the first side wall comprises a first-side lower panel and a first-side upper panel;

wherein the first security flap comprises a first inside panel coupled to the first-side lower panel and a first outside panel coupled to the first-side upper panel;

wherein the second side wall comprises a second-side lower panel and a second-side upper panel; and wherein the second security flap comprises a second inside panel coupled to the second-side lower panel and a second outside panel coupled to the second-side upper panel.

15. A backpack comprising:

a main storage compartment having at least:

a base panel having one or more shoulder straps extending from near a top end of the backpack towards a bottom end of the backpack;

a first side wall having a first lower portion coupled to the base panel on a first side of the backpack and having a first upper portion;

a second side wall having a second lower portion coupled to the base panel on a second side of the backpack and having a second upper portion;

a first stowage compartment comprising a first security flap that is coupled to the first side wall, wherein the first security flap includes a first top portion oriented toward the first upper portion of the first side wall and a first bottom edge oriented toward the first lower portion of the first side wall and toward the base, wherein the first top portion is fixedly secured to the first side wall from near the top of the backpack to near the bottom of the backpack , and wherein the first bottom edge of first security flap is spaced apart from an outside surface of the first side wall to at least partially enclose a first stowage space between an inside surface of the first security flap and the first outside surface of the first side wall; and a second stowage compartment comprising a second security flap that is coupled to the second side wall, wherein the second security flap includes a second top portion oriented toward the second upper portion of the second side wall and a second bottom edge oriented toward the second lower portion of the second side wall and toward the base, wherein the second top portion is fixedly secured to the second side wall from near the top of the backpack to near the bottom of the backpack, and wherein the second bottom edge of second security flap is spaced apart from an outside surface of the second side wall to at least partially enclose a second stowage space between an inside surface of the second security flap and the outside surface of the second side wall.

16. The bag of claim 15, wherein the first upper portion and the second upper portion include a first releasable fastener and second releasable fastener, respectively, that releasably connect to one another to selectively close and open the storage-compartment opening.

17. The bag of claim 15, wherein the second stowage space gradually increasing in volume as the second stowage space extends away from the second top portion and towards the second bottom edge, and wherein the second stowage space gradually increasing in volume as the second stowage space extends away from the second top portion and towards the second bottom edge.

18. The bag of claim 15 further comprising, a first pocket positioned in the first security flap, and a second pocket positioned in the second security flap.

* * * * *